United States Patent [19]

Lehmacher

[11] Patent Number: 4,662,864

[45] Date of Patent: May 5, 1987

[54] APPARATUS FOR STACKING AND PADDING PLASTIC BAGS

[75] Inventor: Hans Lehmacher, Niederkassel-Mondorf, Fed. Rep. of Germany

[73] Assignee: Lemo M. Lehmacher & Sohn GmbH Maschinenfabrik, Niederkassel-Mondorf, Fed. Rep. of Germany

[21] Appl. No.: 894,436

[22] Filed: Jul. 30, 1986

Related U.S. Application Data

[63] Continuation of Ser. No. 726,581, Apr. 23, 1985, abandoned.

[30] Foreign Application Priority Data

Apr. 28, 1984 [DE] Fed. Rep. of Germany ..... 3415992

[51] Int. Cl.[4] ..... B31B 1/64

[52] U.S. Cl. ..... 493/204; 493/194

[58] Field of Search ..... 493/194–196, 493/198–201, 204, 342, 373; 156/520; 83/160

[56] References Cited

U.S. PATENT DOCUMENTS

| | | | |
|---|---|---|---|
| 3,839,935 | 10/1974 | Daniels | 83/160 |
| 3,893,382 | 7/1975 | Bosse et al. | 493/194 |
| 4,181,069 | 1/1980 | Porter | 493/196 |
| 4,451,249 | 5/1984 | de Bin | 493/204 |
| 4,549,877 | 10/1985 | Lehmacher | 493/196 |

FOREIGN PATENT DOCUMENTS 3138221 3/1981 Fed. Rep. of Germany .

*Primary Examiner*—Frederick R. Schmidt
*Assistant Examiner*—Robert Showalter
*Attorney, Agent, or Firm*—Karl F. Ross; Herbert Dubno

[57] ABSTRACT

The delivery suction arms of a transfer mechanism take the individual plastic bag segments to be stacked from a welding and cutting station, swing them to a pin conveyor belt and spindle them on the stack pins of the pin conveyor belt. Three suction arms are positioned next to each other in rows with spacing from each other, two of which grasp an individual plastic bag segment on both sides of pin holes positioned at one end of the individual plastic bags, and in stacking swing past the pin conveyor belt. The remaining or third delivery suction arm grasps the bottom of the individual plastic bag. In the travel direction of the conveyor belt a finishing mechanism is positioned following the delivery mechanism which seals the stacked bags and may provide the bags with handle-holes.

8 Claims, 3 Drawing Figures

APPARATUS FOR STACKING AND PADDING PLASTIC BAGS

This is a continuation of co-pending application Ser. No. 726,581 filed on Apr. 23, 1985, now abandoned.

CROSS REFERENCE TO RELATED APPLICATION

The present application is copending with application Ser. No. 458,265 filed Jan. 17, 1983 and now issued as U.S. Pat. No. 4,549,877.

FIELD OF THE INVENTION

My present invention relates to an improved apparatus for stacking and padding plastic bags and, more particularly, to an improved apparatus for stacking and bonding plastic bags in stacks, the bags being formed from a flattened blown thermoplastic foil tube.

BACKGROUND OF THE INVENTION

Plastic bags can be manufactured in an assembly line process yielding pads of bags formed by stacks containing a plurality of bags in each stack by cutting, and welding a flattened plastic foil tube to form the bags, stacking the bags and heat sealing the bags together at one side. Generally the flattened plastic tube is cut and welded transverse to its tube axis into the individual plastic bag segments.

An apparatus for stacking and padding plastic bags (i.e. sealing the bags of a stack together at one side) usually comprises a welding and cutting station, a pin conveyor belt with a plurality of longitudinally spaced stacking pins, and a delivery mechanism. The delivery mechanism usually comprises a plurality of suction arms extending essentially radially from a hub in rows transverse to the transport direction of the bags. The arms rotate about a horizontal axis. The delivery mechanism takes the individual plastic bag segments formed by the welding and cutting station and also previously formed with at least one pin hole therein and stacks them on the pin conveyor belt with the pin holes being traversed or spindled by the stack pins.

In the stacking and sealing apparatus of this type described in German patent document - open application DE-OS No. 31 38 221 two delivery suction arms are positioned next to each other with a spacing. One arm is movable past the pin conveyor belt on one side of it, while the other arm is movable past the pin conveyor belt on its other side.

Both these delivery suction arms grip a bag segment of the flattened plastic foil tube, which will be cut down its its center later in the process to produce twin plastic bags.

The twin plastic bags are delivered to and suspended from the pin conveyor belt from two rows of pins positioned next to each other. After the bag-separation and welding operation by a tool which extends in the transport direction of the pin conveyor belt and works between each row of stacking pins, two stacks or pads are obtained.

This known stacking and padding apparatus can only work following a machine which is set up for forming twin or doubled plastic bag segments from the flattened plastic foil tube.

However numerous machines exist in practice which form individual plastic bags from a flattened plastic foil tube.

OBJECTS OF THE INVENTION

The principal object of my invention is to provide an improved stacking and padding apparatus which can stack and bond individual plastic bags into a pad as opposed to twin plastic bags.

It is an object of my invention to provide an improved apparatus for assembling, stacking and bonding single plastic bags into pads and the like.

It is also an object of our invention to provide an apparatus for stacking and padding individual plastic bags as part of a plastic bag manufacturing process line.

SUMMARY OF THE INVENTION

These objects and others which will become apparent hereinafter are attained in accordance with my invention in an apparatus for the stacking and sealing of plastic bags, which typically each comprise an individual plastic bag segment having at least one pin hole therethrough and cut from a flattened plastic foil tube, comprising a welding and cutting station for the individual plastic bag segments, a pin conveyor belt having a plurality of stacking pins connected thereto spaced along the length of the pin conveyor belt, the individual plastic bag segments cut from the flattened plastic tube being stackable thereon to form a stack of plastic bag segments, and a delivery mechanism wherein the delivery mechanism has a plurality of delivery suction arms or delivery arms attached in rows to a hub and extending essentially radially from the hub, the delivery mechanism taking one of the individual plastic bag segments from the welding and cutting station, moving it to the pin conveyor belt, and placing it on at least one of the stacking pins of the pin conveyor belt.

According to my invention three delivery suction arms or delivery arms are spaced from each other in each of a plurality of angularly spaced rows, of which two of the three delivery suction arms or delivery arms grasp one end of a respective single plastic bag on each side of the pin holes thereof and in the stacking operation move toward the pin conveyor belt.

The pin conveyor belt has only a single row of stacking pins along its length. The remaining one of the three delivery suction arms or delivery arms, i.e. the third arm grasps the bottom side of the individual plastic bags.

A finishing mechanism is provided following the delivery mechanism in the transport direction, the finishing mechanism comprising a piston-cylinder-driven padding mechanism having a heated sealing blade, a piston-cylinder-driven counter pressure mechanism with a counter-pressure plate, a handle-hole cutter associated with the counter-pressure plate, and an ejector for the padding waste. The sealing blade as well as the counter-pressure plate works on the upper part of the pin conveyor belt and the handle-hole cutter works from below against the counter-pressure plate.

The handle-hole cutter as well as the ejector are operated by piston-cylinder-driven devices, namely a piston-cylinder driven ejector device and a piston-cylinder driven handle-cutter device, which are under the pin conveyor belt. These piston-cylinder driven devices act to, for example,advance the sealing blade into a cutting position.

The invention is based on the recognition that in this type of apparatus it is not required to suspend the individual plastic bag segments from the flattened plastic foil tube over the pin conveyor belt so that the bottom portions of the limited plastic bag portions hang over both sides.

It can thus stack individual plastic bags and pad them at especially high speed in regard to both stacking and padding.

In a preferred embodiment of my invention the piston-cylinder driven sealing mechanism and the piston-cylinder-driven counter pressure mechanism are positioned next to each other, preferably transverse to the transport direction of the individual plastic bags. Furthermore the axis of the piston-cylinder-driven counter-pressure mechanism is oriented vertically during operation and the axis of the piston-cylinder-driven sealing mechanism is inclined. The piston-cylinder handle-cutter device for operating the handle-hole cutter is mounted horizontally and drives an operating roller which engages an inclined operating surface of the handle-hole cutter.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
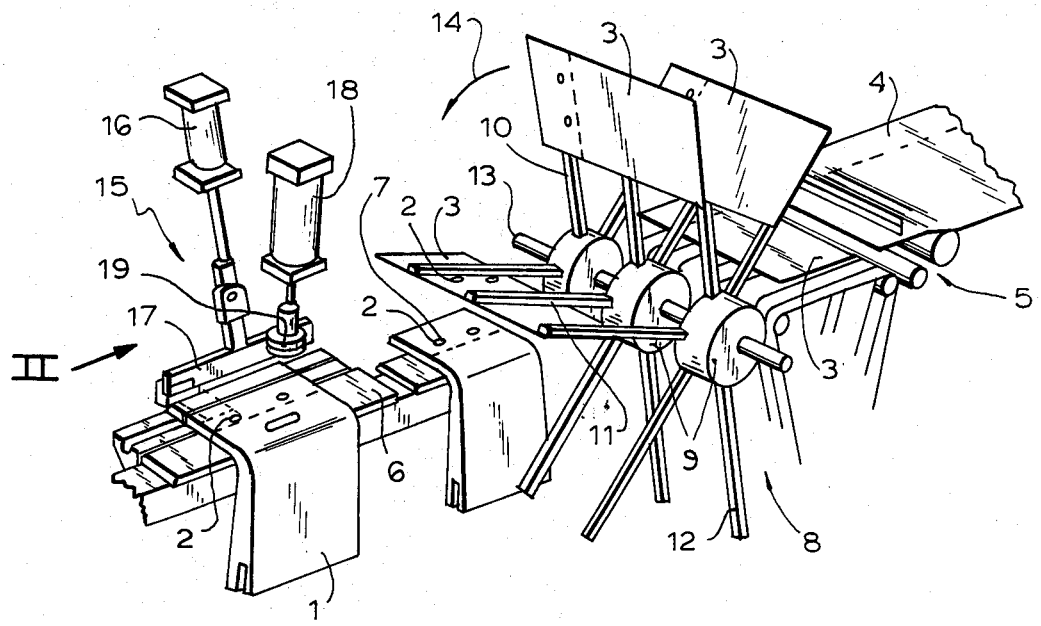
FIG. 1 is a perspective view of a preferred embodiment of the apparatus for stacking and padding plastic bags according to my invention.
Figure 2:
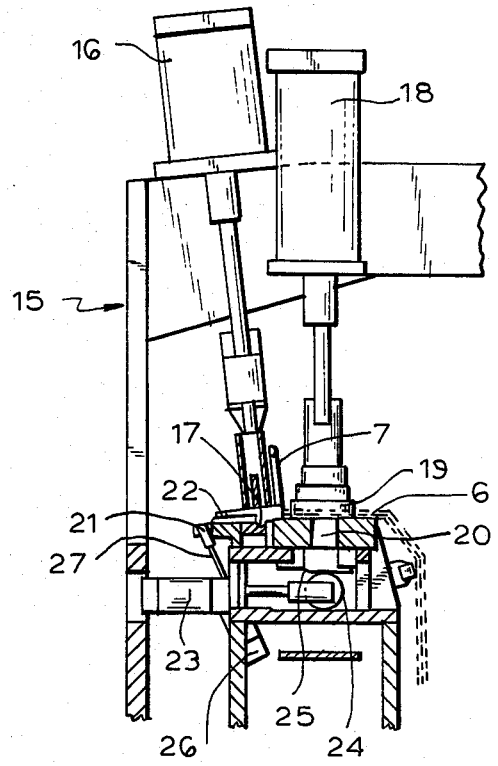
FIG. 2 is a partially vertical cross sectional, partially front view of the apparatus according to FIG. 1 as seen in the direction II.

The apparatus shown in the drawing stacks and bonds or seals plastic bags 1 in pads. The bags are individual plastic bag segments 3 severed from a flattened plastic foil tube 4.

Each individual plastic bag segment 3 has previously been formed with at least one pin hole 2 therein; two pin holes 2 are provided in each bag segment 3 in this example.

A welding and cutting station 5 is positioned upstream of the transfer mechanism along a pin conveyor belt 6 having a row of stacking pins 7 along the length of the pin conveyor belt 6, on which the individual bags are spindled and held by the pins 7 in a stacked structure.

The transfer or delivery mechanism 8 has a plurality of delivery suction arms or delivery arms, in this case three such delivery suction arms 10, 11, and 12, attached to hub 9 in respective angularly spaced rows, the arms extending essentially radially from the hub 9.

These three suction arms 10, 11, and 12 move through a circular arc about horizontal axis 13, as is made clear by the curved arrow 14 in FIG. 1. These suction arms 10, 11, and 12 pick up individual plastic bag segments 3 for stacking from the welding and cutting station 5 and place them on the pin conveyor belt 6 with the stack pins 7 traversing the pin holes 2.

Moreover the arms 10, 11 and 12 swing past the pin conveyor belt 6, which is narrow enough to fit between arms 10 and 11.

According to this invention the two arms 10 and 11 are positioned to straddle the holes on the bag. The individual plastic bag segments 3 are grasped by the delivery suction arms or delivery arms 10, 11 and 12 so that the pin holes 2 at one end of the individual plastic bag segments 3 are positioned with two delivery suction arms 10 and 11 on each side of them and are successively delivered in the previously described way onto the pin conveyor belt 6 and stacked thereon. The remaining or third suction arm 12 grasps the individual bag segment 3 on its bottom side, i.e. remote from the holes.

In the transport direction of the pin conveyor belt 6 downstream of the delivery mechanism 8 a finishing mechanism 15 is provided. This finishing mechanism 15 comprises a piston-cylinder driven sealing mechanism 16 having a heated sealing blade 17, a piston-cylinder operated counter-pressure mechanism 18 having a counter-pressure plate 19, a handle-hole cutter 20 associated with the rotary counter pressure plate 19, and an ejector 21 for the sealing waste 22 which is cut off. The sealing blade 17 as well as the counter-pressure plate 19 work against the upper strand of the pin conveyor belt 6 and the handle-hole cutter 20 works from below against the counter-pressure plate 19. The pin conveyor belt 6 has only a single row of stacking pins 7; it can be constructed as a plate or platform conveyor belt 6.

Figure 3:
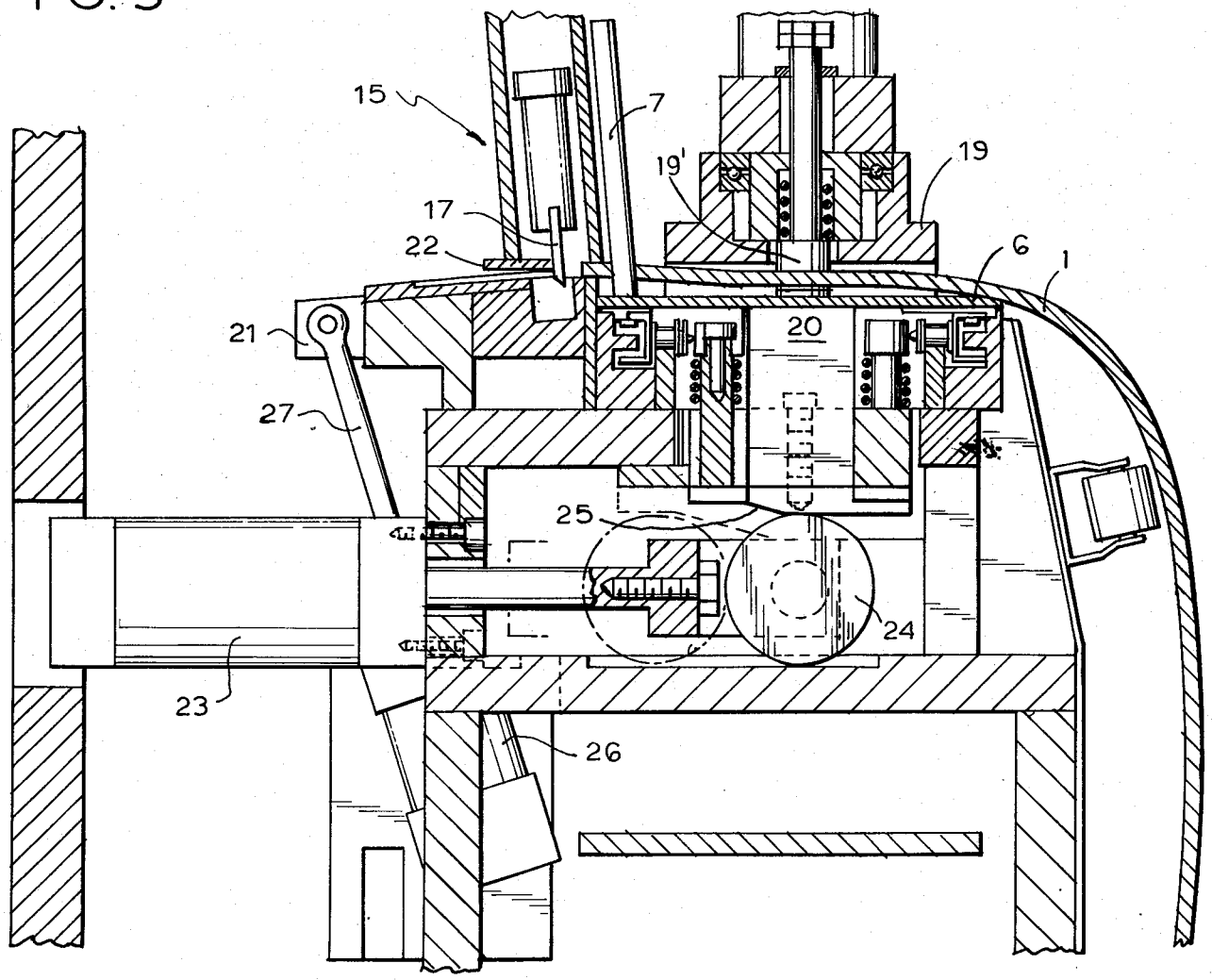
FIG. 3 is a detail view of the bottom half of FIG. 2 showing additional components of the apparatus drawn to an elarged scale.

In this specific example and according to a preferred embodiment the piston-cylinder-driven sealing mechanism 16 and the piston-cylinder counter-pressure mechanism 18 are positioned next to each other, preferably transverse to the travel direction. Thereby the piston-cylinder counter-pressure mechanism 18 works with its axis vertical, the piston-cylinder driven sealing mechanism 16 however is inclined. A piston-cylinder handle-cutter device 23 for driving the handle hole cutter 20 is mounted horizontally and operates by pressing a control roller 24 on a slanting control surface 25 on the handle-hole cutter 20, which is seen referring to FIG. 3.

The control and operating mechanism for the ejector 21 is a piston-cylinder driven ejector device 26, which is arranged under the pin conveyor belt 6, however its piston rod 27 is inclined upwardly.

It is understood that the pin conveyor belt 6 works cyclically. During stacking the pin conveyor belt 6 stops, so that, after the transport cycle is completed, the stacked individual plastic bag segments 3 are carried to the finishing mechanism 15, where sealing occurs during the next stacking process. In the sealing process the stack in the vicinity of the sealing blade 17 is welded together.

I claim:

1. In an apparatus for stacking and padding plastic bags in the form of individual plastic bag segments each with at least one hole therethrough cut from a flattened, plastic foil tube, said apparatus comprising a welding and cutting station for said individual plastic bag segments, a pin conveyor belt having a plurality of stacking pins connected thereto spaced along the length of said pin conveyor belt, said individual plastic bag segments being stackable thereon to form a stack of said individual plastic bag segments, and a delivery mechanism, said delivery mechanism having a plurality of delivery suction arms attached in rows to a hub and extending essentially radially therefrom, said delivery mechanism taking one of said individual plastic bag segments from said welding and cutting station for stacking, swinging said one of said individual plastic bag segments to said pin conveyor belt, and placing said one of said individual plastic bag segments on said pin conveyor belt engaging said hole on one of said stacking pins, the improvement wherein three of said delivery suction arms are spaced from each other in each of said rows, of which two of said three delivery suction arms grasp one end of each of said individual plastic bag segments on each side of the respective hole and in stacking swing toward said pin conveyor belt, said pin conveyor belt having only a single row of said stacking pins, the remaining one of three delivery suction arms of each row grasping the bottom side of the respective plastic bag segment; and a finishing mechanism is provided following said delivery mechanism in a transport direction of said individual plastic bag segments, said finishing mechanism comprising a piston-cylinder driven sealing mechanism having a heated sealing blade, a piston-cylinder counter pressure mechanism with a counter pressure plate, a handle-hole cutter associated with said counter pressure plate, and an ejector for the sealing waste, wherein said sealing blade as well as said counter pressure plate work on the upper part of said pin conveyor belt, and said handle-hole cutter works from below against said counter pressure plate, and wherein said handle-hole cutter as well as said ejector are operated by a piston-cylinder driven ejector device and a piston-cylinder driven handle cutter device, which are positioned under said pin conveyor belt, and wherein the axis of said piston-cylinder counter pressure mechanism is oriented vertically, and the axis of said piston-cylinder driven sealing mechanism is inclined, and said driven sealing mechanism and said counter pressure mechanism are positioned next to each other.

2. The improvement according to claim 1 wherein said piston-cylinder handle cutter device for operating said handle-hole cutter is mounted horizontally and drives an operating roller which engages an inclined operating surface on said handle-hole cutter.

3. In an apparatus for stacking and sealing of plastic bags, which comprise individual plastic bag segments each with at least one pin hole therethrough cut from a flattened, plastic foil tube, said apparatus comprising a welding and cutting station for said individual plastic bag segments, a pin conveyor belt having a plurality of stacking pins connected thereto spaced along the length of said pin conveyor belt, said individual plastic bag segments being stackable thereon to form a stack of said individual plastic bag segments, and a delivery mechanism, wherein said delivery mechanism has a plurality of delivery arms attached in rows to a hub and extending substantially radially therefrom, said delivery mechanism taking one of said individual plastic bag segments from said welding and cutting station, moving said one of said individual plastic bag segments to said pin conveyor belt, and placing said one of said individual plastic bag segments on said pin conveyor belt engaging each of said pin holes in one of said stacking pins, the improvement wherein three of said delivery arms are spaced from each other in said rows, of which two of said three delivery arms grasp one end of one of said individual plastic bag segments on each side of each one of said pin holes and in stacking swing toward said pin conveyor belt, said pin conveyor belt having only a single row of said stacking pins, the remaining one of said three delivery arms grasping the bottom side of said one of said individual plastic bag segments, and a finishing mechanism is provided following said delivery mechanism in the transport direction of said individual plastic bag segments.

4. The improvement according to claim 3 wherein said finishing mechanism comprises a piston-cylinder driven sealing mechanism having a heated sealing blade, a piston-cylinder counter pressure mechanism with a counter pressure plate, a handle-hole cutter associated with said counter pressure plate, and an ejector for the sealing waste, wherein said sealing blade as well as said counter pressure plate work on the upper part of said pin conveyor belt, and said handle-hole cutter works from below against said counter pressure plate, and wherein said handle-hole cutter as well as said ejector are operated by a piston-cylinder driven ejector device and a piston-cylinder driven handle cutter device, which are positioned under said pin conveyor belt.

5. The improvement according to claim 3 wherein each of said delivery arms comprises a delivery suction arm.

6. The improvement according to claim 4 wherein said piston-cylinder driven sealing mechanism and said piston-cylinder counter pressure mechanism are positioned next to each other transverse to said transport direction of said individual plastic bag segments.

7. A bag stacking and padding apparatus comprising:

a pin conveyor having a single row of pins and movable in a transport direction;

a bag cutting and seaming station upstream of said conveyor for producing a succession of bags each having a pair of holes at an upper side and a closed bottom side;

a transfer mechanism downstream of said station comprising a plurality of angularly spaced rows of arms each engageable with one of said bags, two arms of each row straddling the pair of holes at said upper side and another arm engaging the respective bag at the bottom side, said mechanism swinging each bag onto said conveyor whereby each pair of holes is impaled by two of said pins and a stack of said bags is formed on said conveyor; and means downstream of said mechanism along said path for welding the bags of said stack together into a pad.

8. In an apparatus for stacking and padding plastic bags in the form of individual plastic bag segments each with at least one hole therethrough cut from a flattened, plastic foil tube, said apparatus comprising a welding and cutting station for said individual plastic bag segments, a pin conveyor belt having a plurality of stacking pins connected thereto spaced along the length of said pin conveyor belt, said individual plastic bag segments being stackable thereon to form a stack of said individual plastic bag segments, and a delivery mechanism, said delivery mechanism having a plurality of delivery suction arms attached in rows to a hub and extending essentially radially therefrom, said delivery mechanism taking one of said individual plastic bag segments from said welding and cutting station for stacking, swinging said one of said individual plastic bag segments to said pin conveyor belt, and placing said one of said individual plastic bag segments on said pin conveyor belt engaging said hole on one of said stacking pins, the improvement wherein three of said delivery suction arms are spaced from each other in each of said rows, of which tow of said three delivery suction arms grasp one end of each of said individual plastic bag segments on each side of the respective hole and in stacking swing toward said pin conveyor belt, said pin conveyor belt having only a single row of said stacking pins, the remaining one of three delivery suction arms of each row grasping the bottom side of the respective plastic bag segment; and a finishing mechanism is provided following said delivery mechanism in a transport direction of said individual plastic bag segments, said finishing mechanism comprising a piston-cylinder driven sealing mechanism having a heated sealing blade, a piston-cylinder couter pressure mechanism with a counter pressure plate, a handle-hole cutter associated with said counter pressure plate, and an ejector for the sealing waste, wherein said sealing blade as well as said counter pressure plate work on the upper part of said pin conveyor belt, and said handle-hole cutter works from below against said counter pressure plate, and wherein said handle-hole cutter as well as said ejector are operated by a piston-cylinder driven ejector device and a piston-cylinder driven handle cutter device, which are positioned under said pin conveyor belt, and wherein said piston-cylinder handle cutter device for operating said handle-hole cutter is mounted horizontally and drives an operating roller which engages an inclined operating surface on said handle-hole cutter.

* * * * *